United States Patent [19]

Morrison

[11] 4,057,247

[45] Nov. 8, 1977

[54] BALANCING TOY SET

[75] Inventor: Howard J. Morrison, Deerfield, Ill.

[73] Assignee: Marvin Glass & Associates, Chicago, Ill.

[21] Appl. No.: 637,728

[22] Filed: Dec. 4, 1975

[51] Int. Cl.[2] ..... A63H 15/00

[52] U.S. Cl. ..... 273/1 R; 46/22; 46/131; 273/156

[58] Field of Search ..... 273/1 R, 156; 46/32, 46/131, 22; 40/126, 106.3; 35/19 R

[56] References Cited

U.S. PATENT DOCUMENTS

| | | | |
|---|---|---|---|
| 1,974,737 | 9/1934 | Casteig | 273/1 R |
| 3,402,929 | 9/1968 | Glass | 273/1 R |
| 3,417,506 | 12/1968 | Howell | 46/131 |
| 3,460,831 | 8/1969 | Glass | 273/1 R |
| 3,614,106 | 10/1971 | Morrison et al. | 273/156 |
| 3,885,342 | 5/1975 | Morrison et al. | 46/22 |

*Primary Examiner*—William H. Grieb
*Attorney, Agent, or Firm*—Mason, Kolehmainen, Rathburn & Wyss

[57] ABSTRACT

An instructional balancing toy set for use, for instance, by preschool children to amuse and entertain the children while at the same time conveying concepts of object size and object weight. The device includes a base and a plurality of vertically stackable balancing members. The base is upwardly converging and frustoconical in shape and rests on a support surface, and has a circular top lip which receives a generally spherical intermediate second balancing member to hold the spherical member in a predetermined upright proper orientation. The spherical member when properly oriented, includes an upwardly projecting lug at the top thereof which is received in a lug receiver on the bottom of a figurine to support the figurine in upright position on top of the spherical member as a third member of the assembly. The figurine member includes a generally concave depression on the top surface thereof.

Additional vertically stackable balancing members are intended to be stacked in a certain order and have decreasing size and weight characteristics progressively from the bottom of the stack to the top. Each member, in the form of a figurine or portion of a figurine, has a bottom pointed projection for forming a fulcrum when supported in a top depression of another member. Each also has opposing outwardly and downwardly projecting arms terminating in weights of sufficient mass, the weights being sufficiently below the respective bottom pointed projection so that when the balancing member is placed with the tapered point received in the concave depression at the top of the lower balancing member, a fulcrum effect and stable balancing equilibrium can be achieved.

The device can be constructed in a special form in which the balancing members are intended to be vertically oriented in a particular seriatim order. In such form, the balancing member weights are of a proper mass and at a proper distance below the balancing point or fulcrum so as to be insufficient to provide stable equilibrium for a stack in which a heavier balancing member is positioned out of order thereabove. Stable equilibrium will not be achieved and the stack will fall causing the child to try again until the balancing members are in proper order.

7 Claims, 2 Drawing Figures

BALANCING TOY SET

BACKGROUND OF THE INVENTION

1. Field of the Invention

The present invention relates generally to toys and in particular to a balancing figure toy set for the entertainment, amusement and education or preschool children.

2. Brief Description of the Prior Art

Balancing sets for use in games of skill, such as the one described by Morrison et al in U.S. Pat. No. 3,614,106, entitled "Balancing Puzzle Device", issued Oct. 19, 1971, have found acceptance in the field. Other stackable devices or sets have been relied upon to acquaint preschool children with differences in sizes and weights of objects. One such commonly acceptable set consists of a series of stackable blocks which, when properly stacked, decrease in size as the stack progresses upwardly. Another common play item for preschool children includes a post on which rings can be placed in a vertical frusto-conical stack with the rings decreasing in size as the stack progresses. Such devices have simplicity and are entertaining and amusing to the preschool child.

SUMMARY OF THE INVENTION

The present invention provides a balancing toy set which is useful in the entertainment, amusement and education of children, particularly preschool children. The balancing toy set includes a base portion which has a plurality of verticaly stackable base members thereabove, interengageable with each other to form a stable assembly. A plurality of balancing members are provided to create a stack of balancing members upwardly from the top of the base. Accordingly, upper balancing members are provided with a downwardly protruding tapered point at the bottom thereof. The uppermost members of the assembly include an upwardly facing concave depression for receiving the tapered point at the bottom of a balancing member so that the point and depression combination function has a fulcrum on which the balancing members are balanced.

The balancing members all include curved arms protruding outwardly and downwardly from two opposite sides thereof. The arms extend to a position below the fulcrum point of the balancing member and have sufficient weights on the ends thereof to maintain the respective balancing member in stabilized equilibrium even with the additional balancing members intended to be stacked thereon in the stacked condition.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

DETAILED DESCRIPTION OF THE PREFERRED EMBODIMENT

Figure 1:
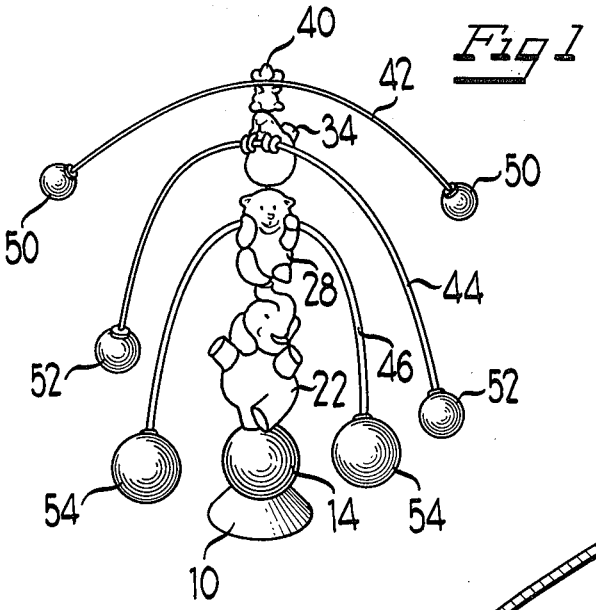
FIG. 1 is a perspective view of an embodiment of the balancing toy in accordance with this invention showing a plurality of balancing figurines stacked on a base assembly.
Figure 2:
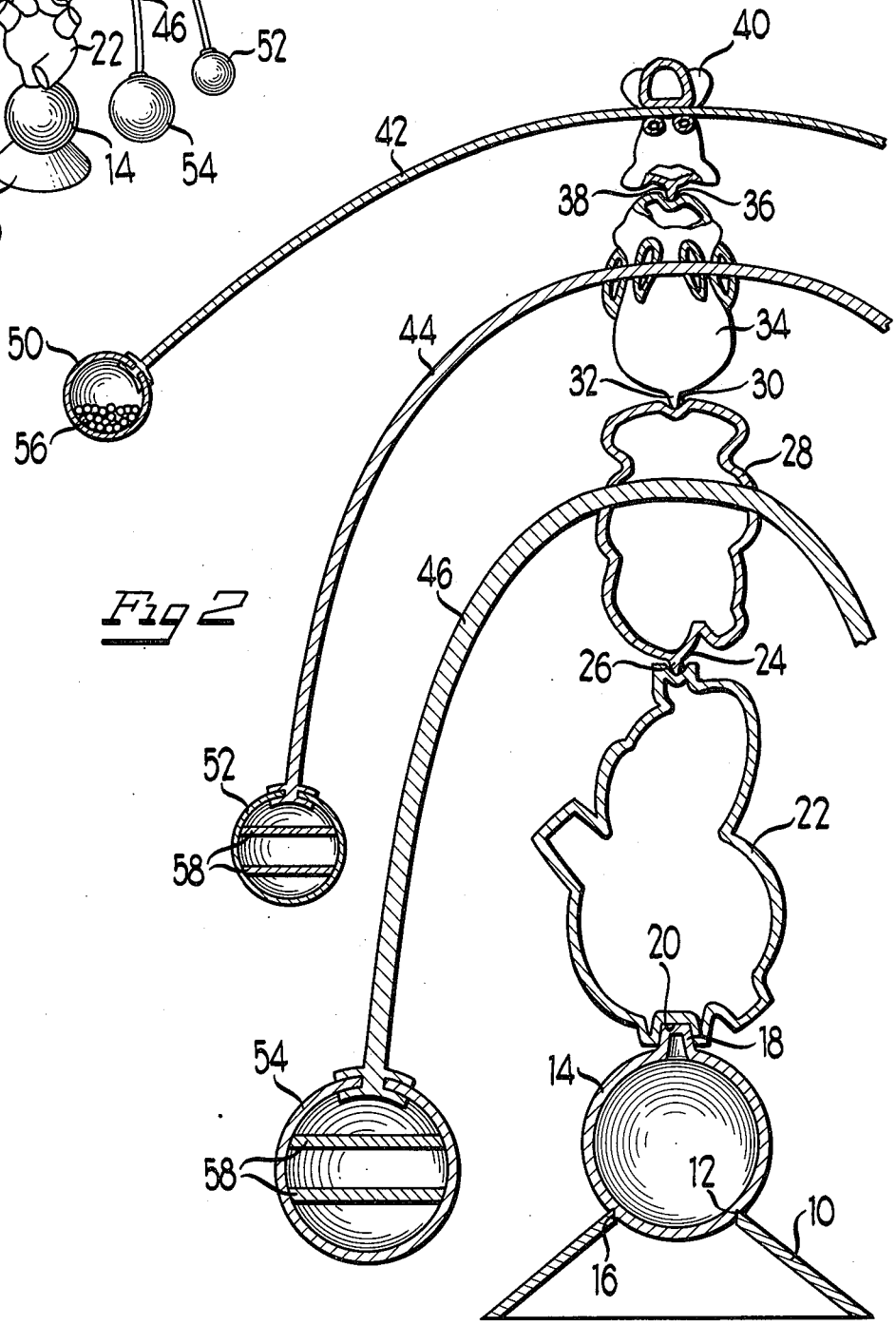
FIG. 2 is a fragmentary vertical section, on an enlarged scale, through the embodiment of FIG. 1 illustrating interconnection between portions of a stacked base assembly and engagement of the stacked balancing members with the base assembly and with each other.

The device shown in FIGS. 1 and 2 has a base assembly comprised of three stackable units or members including a frusto-conical base member 10 tapering inwardly toward an upper circular lip 12. Base member 10 supports a hollow sphere 14 having a circular groove 16 receiving the upper lip 12 and centering an upstanding lug 18 generally coaxially with the frusto-conical base member 10 and sphere 14. Lug 18 is received by a recessed lug receiver 20 on the bottom of a hollow figurine 22 having an elephant-like form with an upwardly facing concave or cup-like depression 24 at the top thereof.

Mounted on the base assembly is a vertical series of balancing members, three shown in the illustrated embodiment. Accordingly, a downwardly pointed fulcrum projection 26 of a first balancing member 28, in the form of a bear-like figurine is received in the cup-like depression 24 and in turn has an upwardly facing concave or cup-like depression 30 which forms a receiver for a downwardly pointed fulcrum projection 32 on the bottom of a second balancing member 34, in the form of a beaver or the like. Balancing member 34 again has a top depression 36 for receiving a downwardly pointed flucrum projection 38 of still a third balancing member 40, in the form of a squirrel or similar small animal.

In order to permit the balancing members to stack and be properly balanced, each is provided with a pair of arms 42, 44, 46, having weights 50, 52, 54, respectively, in the form of hollow spheres at the ends of the arms. The spheres 50, 52, 54 may be partially filled with weighting materials such as shot 56, and/or ribs 58. In the exemplary form, the arms 42, 44, 46 will be of resilient members impaling the balancing figures and secured thereto against appreciable longitudinal movement relative thereto.

The members of the base assembly have proper serial oriented stacking order as is determined by the lip 12 and groove 16 and by the lug 18 and receiver 20. The balancing members 28, 34 and 40 also have a predetermined stacking order with the largest and heaviest balancing member 28 at the bottom and progressing with balancing members 34 and 40 of lesser weight and size from there up. The combination of arms 42, 44, 46 and spheres 50, 52, 54 and any weights contained within the spheres lowers the center of gravity for each balancing member sufficiently below its fulcrum projection to accommodate its own weight and the weight of all balancing members stacked thereabove so that when the balancing members are stacked in proper order a stable balanced equilibrium is achieved. Once the balancing members are properly stacked a child can be further amused by spinning the balancing members relative to each other with the fulcrum acting as pivot points and the balancing members remaining in their stacked condition.

It will be apparent that the present invention has many advantages in the entertainment and amusement of children. Further, the balancing toy exposes children to concepts of weight, size and center of gravity and in this way is partly an educational and instruction toy.

The foregoing detailed description has been given for clearness of understanding only and no unnecessary limitations should be understood therefrom as some modifications will be obvious to those skilled in the art.

I claim:

1. A balancing toy set, comprising: a base portion for positioning on a support surface such as a table or the like; and a plurality of balancing members each having complementary fulcrum portions at the tops and bottoms of at least some of the members for vertically stacking on the base, each balancing member having a pair of opposing outwardly and downwardly extending arms having weighted hollow spherical balls on the ends thereof, the arms being of sufficient length and weight so as to lower the center of gravity of the respective balancing members below the bottom of the respective member, said weights for the respective balancing members being of different amounts and the arms being of different lengths proportionate to the respective weights compared with the weights of other members so that the balancing members can be stacked on said base in a progressive upwardly decreasing series with the lightest weighted member at the top of the stack, and wherein said balancing members are of different sizes proportionate to the length of the arms and the amounts of the weights thereon.

2. A balancing toy set, comprising: a base portion for positioning on a support surface such as a table or the like; and a plurality of balancing members each having complementary fulcrum portions at the tops and bottoms of at least some of the members for vertically stacking on the base, each balancing member having a pair of opposing outwardly and downwardly extending arms having weighted hollow spherical balls on the ends thereof, the arms being of sufficient length and weight so as to lower the center of gravity of the respective balancing members below the bottom of the respective member, said balancing members being shaped in the form of various types of animals of different sizes comparable with their species with arms differing in length in proportion to the sizes of the balancing members for progressively stacking the balancing members in a decreasing size order vertically above said base, said weights on the ends of said arms differing in amount but being proportionate to the length of the arms and the respective corresponding sizes of the animal characters formed by the balancing members.

3. A balancing toy set, comprising: a base assembly including a base portion, having a recess in the top thereof, for positioning on a support surface such as a table or the like and a plurality of stackable members for stacking on said base portion, one of said stackable members being spherical with an upstanding fulcrum portion in the form of a lug at the top thereof; and a plurality of balancing members each having complementary fulcrum portions at the top and bottom of the member for vertically stacking on the base assembly, each of said balancing members having a pair of opposing outwardly and downwardly extending arms of different lengths having weights on the ends thereof, the arms being of sufficient length and the weights being of sufficient weight so as to lower the center of gravity of the respective balancing members below the bottom of the respective member so that the balancing members can be stacked in the stack with the length of the arms and the weight of the weights of the balancing members decreasing upwardly in the stack.

4. The balancing toy set of claim 3 wherein the recess of said base portion has a marginal peripheral lip about said recess and said spherical member has a circular groove for receiving said lip.

5. The balancing toy set of claim 3 wherein said balancing members are shaped in the form of figurines of different sizes and the topmost stackable member of said base assembly comprises a figurine larger than any of the figurine balancing members.

6. A balancing toy set, comprising: a base portion for positioning on a support surface such as a table or the like, and a plurality of balancing members each having complementary fulcrum portions at the top and bottom of the member for vertically stacking on the base, each balancing member having a pair of opposing outwardly and downwardly extending arms of different lengths having weights on the ends thereof, the arms being of sufficient length and the weights being of sufficient weight so as to lower the center of gravity of the respective balancing members below the bottom of the respective member so that the members can be stacked in the stack with the length of the arms and the weight of the weights of the balancing members decreasing upwardly in the stack, wherein said balancing members are shaped in the form of various types of animals of different sizes comparable with their species for progressively stacking the balancing members in a decreasing size order vertically above said base.

7. The balancing toy set of claim 6 wherein said arms for each of said balancing members differ in length but in proportion to the sizes of the balancing members.

* * * * *